US006288342B1

(12) United States Patent
Ueoka et al.

(10) Patent No.: US 6,288,342 B1
(45) Date of Patent: Sep. 11, 2001

(54) INSULATED WIRE

(75) Inventors: Isao Ueoka; Masaaki Yamauchi, both of Osaka; Masaharu Kurata, Aichi; Yoshihiro Nakazawa, Aichi; Yuki Matsuura, Aichi; Hideyuki Hashimoto, Aichi; Hiromitu Asai, Aichi-pref; Shinichi Matsubara, Aichi-pref; Makoto Takahashi, Aichi-pref, all of (JP)

(73) Assignees: Sumitomo Electric Industries, Ltd., Osaka; Denso Corporation, Aichi-pref, both of (JP)

( * ) Notice: Subject to any disclaimer, the term of this patent is extended or adjusted under 35 U.S.C. 154(b) by 0 days.

(21) Appl. No.: 09/460,647

(22) Filed: Dec. 14, 1999

(30) Foreign Application Priority Data

| | | |
|---|---|---|
| Dec. 15, 1998 | (JP) | 10-355506 |
| Aug. 10, 1999 | (JP) | 11-225914 |
| Nov. 30, 1999 | (JP) | 11-339536 |

(51) Int. Cl.[7] ..... H01B 17/60

(52) U.S. Cl. ..... 174/137 B; 428/383; 427/207.1; 174/110 SR; 174/120 SR

(58) Field of Search ..... 174/137 B, 110 N, 174/110 PM, 110 SR, 120 SR; 156/51; 428/383; 29/887; 427/207.1

(56) References Cited

U.S. PATENT DOCUMENTS

| | | | | |
|---|---|---|---|---|
| 3,922,465 | | 11/1975 | Kawaguchi et al. | 428/383 |
| 4,258,155 | | 3/1981 | Holub et al. | 525/431 |
| 4,546,041 | | 10/1985 | Keane et al. | 428/372 |
| 5,219,657 | * | 6/1993 | Ueoka et al. | 428/379 |
| 5,393,612 | | 2/1995 | Matsuura et al. | 428/458 |
| 5,532,334 | | 7/1996 | Choi et al. | 528/350 |
| 5,824,412 | * | 10/1998 | Hausmann | 428/378 |
| 5,902,681 | * | 5/1999 | Ueoka et al. | 428/383 |
| 6,064,002 | * | 5/2000 | Hayami et al. | 174/52.1 |

FOREIGN PATENT DOCUMENTS

| | | | |
|---|---|---|---|
| 0 365 877 | 10/1989 | (EP) | H01B/3/30 |
| 34828 | 3/1983 | (JP) . | |
| 58519 | 3/1987 | (JP) . | |
| 196025 | 7/1994 | (JP) . | |

OTHER PUBLICATIONS

European Search Report for European Application No. 99310124, published Mar. 29, 2000.

* cited by examiner

*Primary Examiner*—Dean A. Reichard
*Assistant Examiner*—W. David Walkenhorst
(74) *Attorney, Agent, or Firm*—Smith, Gambrell & Russell, LLP

(57) ABSTRACT

An insulated wire having excellent fabricability causing no cracking in the film even after severe winding or rolling fabrication and also having heat resistance comparable to that of polyamideimide is disclosed, in which a first insulation layer of a thermosetting resin composition having a Tg of 250° C. or higher is formed on a conductor, on which a second insulation layer formed of a mixture of a thermosetting resin composition having a Tg of 250° C. or higher and a thermoplastic resin composition having a Tg of 140° C. or higher is formed, and in which the adhesion of the insulation film to the conductor is 30 g/mm or more, and the elongation at break of the insulation film is 40% or more, with the mixing ratio of the thermoplastic resin in the second insulation layer being from 30 to 70% by weight and the ratio $T_1/T_2$ of the thickness $T_1$ of the first insulation layer to the thickness $T_2$ of the second insulation layer being within a range of 5/95 to 40/60, and a residual amount of the solvent in an insulation film is 0.05% by weight or less of the total amount of the insulation film in a preferred embodiment.

23 Claims, No Drawings

INSULATED WIRE

BACKGROUND OF THE INVENTION

1. Field of the Invention

This invention relates to a round or flat insulated wire used as magnet wires for various kinds of electric coils in electric and electronic equipment.

2. Description of the Related Art

In recent years, combined with down-sizing and weight reducing tendency for equipment in various fields such as in the automobile and electric or electronic industries, the demand has grown for reduced size and weight of coils used in such equipment as well as low cost manufacturing while maintaining high performance such as electric characteristics, mechanical characteristics and long lasting heat resistance. Therefore, it is necessary for forming coils to wind magnet wires around a smaller core at a higher density and at a higher speed, which results in damaging the insulation film for the magnet wires, thereby deteriorating the electromechanical characteristics of equipment or lowering the production yield.

For coping with the problems, countermeasures have been taken for the insulation film of insulated wires such as (1) improvement of mechanical strength, (2) improvement of flexibility, (3) improvement of lubrication and (4) improvement of adhesion with conductors. For example, Japanese Patent Application Laid-Open No. 196025/1994 (a) describes the technique of improving the resistance to fabrication of a heat resistant insulation film made of polyamideimide, polyimide or aromatic polyamide by properly setting the tensile strength, tensile modulus of elasticity, adhesion and static friction coefficient to piano wires. Further, Japanese Patent Application Laid-Open No. 58519/1987 (b) discloses a flat insulated wire formed by coating and baking an enamel prepared by adding a polyisocyanate block material blocked with a polyesterimide and a phenolic compound to a polyetherimide. Further, Japanese Patent Application Laid-Open No. 34828/1983 (c) discloses a blend of a polyamideimide and a polyetherimide, to obtain a material having mechanical characteristics comparable with those of the polyetherimide and excellent in solvent resistance, abrasion resistance and long lasting heat resistance.

However, in the technique disclosed in (a), while the insulation film is constituted taking into consideration the improvements (1), (3) and (4), the flexibility is not always sufficient. In the technique disclosed in (b) the problems of degradation due to fabrication and lowering of thermal impact resistance of insulation film caused by rolling an insulated wire to have a flat square shape by combining the flexibility of the polyetherimide, the heat resistance and the adhesion of the polyesterimide to the conductor, and the solderability of phenolic compound-blocked polyisocyanate, but the film does not have sufficient flexibility since elongation at the break of the polyesterimide is inadequate (for example, refer to Comparative Example 7 in this specification). Each of the blend materials obtained in (c) has low glass transition temperature (refer to Table 2 of the patent publication (c)), and the heat resistance is not sufficient to be used as a heat resistant magnet wire material.

As has been described above, although the related art as in (a), (b) and (c) described above can solve the given subjects respectively as the magnet wire material, they are not yet completely satisfactory for obtaining further excellent winding fabricability while maintaining high heat resistance. It may be attributable to the provision of different characteristics which is intended in any of the prior arts is done basically by combining various materials in a single layered structure.

SUMMARY OF THE INVENTION

It is an object of this invention to provide a novel insulated wire excellent in flexibility of an insulation film, suffering from no cracking to the film even undergoing severe winding fabrication or rolling fabrication, having excellent fabricability together with high heat resistance and, more preferably, excellent weldability of the insulation film near the welded portion in that it neither causes blister due to heat upon welding nor increases a discoloration length in the step of welding terminal ends of an insulated wire.

The present inventors have studied in earnest a method capable of making high heat resistance and fabricability compatible while taking various problems into consideration and, as a result, found that the foregoing subjects can be solved by a method as described later, leading to the accomplishment of this invention.

That is, this invention provides an insulated wire, which comprises a first insulation layer (A) comprising a thermosetting resin having a glass transition temperature of 250° C. or higher as a main ingredient formed on a conductor; and a second insulation layer (B) comprising a resin, as a main ingredient, formed by mixing a thermosetting resin (B1) having a glass transition of 250° C. or higher with 10 to 90% by weight of a thermoplastic resin (B2) having a glass transition temperature of 140° C. or higher, formed on the first insulation layer (A), wherein the insulation film comprising the first insulation layer (A) and the second insulation layer (B) has an elongation at break of 40% or more and an adhesion to the conductor of 30 g/mm or more.

Further, this invention provides an insulated wire in which the mixing ratio of the thermoplastic resin (B2) having a glass transition temperature of 140° C. or higher in the second insulation layer (B) is from 30 to 70% by weight, and a ratio ($T_1/T_2$) of a thickness $T_1$ of the first insulation layer (A) to a thickness $T_2$ of the second insulation layer (B) is within a range of from 5/95 to 40/60.

Furthermore, a residual amount of a solvent in the insulation film is preferably 0.05% by weight or less based on the total amount of the insulation film in this invention.

It is considered that the foregoing object can be attained in accordance with this invention by the reasons described below.

(1) By setting the adhesion of the insulation film to the conductor to 30 g/mm or more and setting the elongation at break of the insulation film to 40% or more, flexibility of the film capable of withstanding severe winding fabrication can be attained. Even if the elongation at break of the insulation film is 40% or more, if the adhesion to the conductor is less than 30 g/mm, the film of the insulated wire is exfoliated from the conductor, or the film is creased to cause cracking in the film when put to a flexibility test. On the other hand, even if the adhesion to the conductor is 30 g/mm or more, if the elongation at break of the insulation film is less than 40%, the film is cracked by the flexibility test in a similar manner as described above.

(2) In addition to the condition described above, the flexibility and the heat resistance of the insulation film can be made compatible by forming the first insulation layer (A) with a thermosetting resin having a glass transition temperature of 250° C. or higher and forming the second insulation layer (B) with a resin formed by mixing a thermosetting resin (B1) having a glass transition temperature of 250° C. or higher with a thermoplastic resin (B32) having a glass transition temperature of 140° C. or higher, with a mixing ratio of (B2) to (B1) being set within a range from 10 to 90% by weight. The heat resistance mentioned herein is evaluated by a heat softening temperature measured by a method described later, and it is necessary that the softening temperature is 400° C. or higher.

(3) Balance between the adhesion to the conductor and the elongation at break of the insulation film, which is thus far difficult to attain by the single layer structure, can be obtained, and the flexibility can be improved for the entire insulation film, by combining the first insulation layer (A) and the second insulation layer (B). Existent insulated wires often cause a problem that though the flexibility can be satisfied in round wires, the flexibility cannot be satisfied when they are rolled into a flat square shape. However, the flexibility is not deteriorated in the insulated wire according to this invention even when rolled into the flat square shape.

4) Satisfactory adhesion to the conductor and high flexibility can be provided to the insulation film by laminating the second insulation layer (B) having an excellent flexibility, which is obtained by making the mixing ratio of the thermoplastic resin (B2) with the thermosetting resin (B1) to fall within the range of 30 to 70% by weight of the total resin, onto the first insulation layer (A) comprising the thermosetting resin. Then, as a result, high endurance to serve rolling fabrication or winding fabrication can be provided to the insulated wire.

(5) The heat resistance for the entire insulation film can be kept at a high level comparable with that of the insulation layer consisting of a thermosetting polyamideimide while keeping the high flexibility, by defining the mixing ratio of the thermoplastic resin in the second insulation layer (B) as described above, setting the glass transition temperature of the thermoplastic resin to 140° C. or higher, and setting the ratio ($T_1/T_2$) of the film thickness $T_1$ of the first insulation layer to the film thickness $T_2$ of the second insulation layer within a range from 5/95 to 40/60.

(6) Further, by adopting a laminate structure comprising the first and second insulation layers and ensuring satisfactory adhesion to the conductor, by defining the mixing amount of the thermoplastic resin in the second insulation layer to heightening the glass transition temperature of the thermoplastic resin, thereby keeping the level of the heat resistance as the entire insulation film at a level comparable with that of the polyamideimide, and by reducing the residual amount of the solvent in the entire insulation film to 0.05% or less by weight relative to the total amount of the insulation film, the blister of the insulation film due to the welding heat and the increase of discoloration length thereof can more reliably be prevented at or near the welded portions in the step of welding terminal ends of the insulated wires. That is, weldability of the insulated wire can be improved.

DESCRIPTION OF THE PREFERRED EMBODIMENTS

In this invention, any thermosetting resin can be used for forming the first insulation layer (A) so long as it has a glass transition temperature (Tg) of 250° C. or higher and the adhesion to the conductor of the insulation layer formed together with the second insulation layer (B) can be made 30 g/mm or higher.

Specific examples include polyamideimide (about 280° C.), polyimide (about 420° C.), polybenzimidazole (about 425° C.), aromatic polyamide (about 275° C. and about 355° C.) and polyparabanic acid (about 290° C.), in which values in the parentheses represent Tg values obtained by the differential scanning calorimetry (DSC). Of these, polyamideimide or polyimide is particularly preferred in view of cost and performance such as heat resistance and mechanical characteristics.

Polyamideimide is a resin having amide welds and imide welds in the molecule and those produced by known production methods can be used such as (1) polymerization of a diisocyanate ingredient with an acid ingredient, (2) reaction of a diamine ingredient and an acid ingredient, followed by polymerization of the reaction product with an equimolar amount of a diisocyanate ingredient, and (3) polymerization of an acid ingredient including an acid chloride with a diamine ingredient.

As the diisocyanate ingredient of the polyamideimide produced by the production process (1), aromatic diisocyanates having flexible welding in the molecule, such as diphenylmethane-4, 4'-diisocyanate, diphenylmethane-3, 3'-diisocyanate, diphenylmethane-3, 4'-diisocyanate, diphenylether-4, 4'-diisocyanate, benzeophenone-4, 4'-diisocyanate, diphenylsulfone-4, 4'-diisocyanate, tolylene-2, 4-diisocyanate, m-xylylene diisocyanate, and p-xylylene diisocyanate; and aromatic diisocyanates having highly strong skeletons in the molecule, such as biphenyl-4,4'-diisocyanate, biphenyl-3,3'-diisocyanate, biphenyl-3,4'-diisocyanate, 3,3'-dichlorobiphenyl-4,4'-diisocyanate, 3,3'-dichlorobiphenyl-4,4'-diisocyanate, 2,2'-dicorobiphenyl-4, 4'-diisocyanate, 3,3'-dibromobiphenyl-4,4'-diisocyanate, 2,2'-dimethylbiphenyl-4,4-'diisocyanate, 3,3'-dimethylbiphenyl-4,4'-diisocyanate, 2,2'-dimethylbiphenyl-4,4'-diisocyanate, 2,3'-dimethylbiphenyl-4,4'-diisocyanate, 3,3'-dimethylbiphenyl-4,4'-diisocyanate, 2,2'-dimethylbiphenyl-4,4'-diisocyanate, 3,3'-dimethoxybiphenyl-4,4'-diisocyanate, 2,2'-diethoxybiphenyl-4,4'-diisocyanate, 2,3'-dimethoxybiphenyl-4,4'-diisocyanate, 3,3'-diethoxybiphenyl-4,4'-diisocyanate, 2,2'-diethoxybiphenyl-4,4'-diisocyanate and 2,3'-diethoxybiphenyl-4,4'-diisocyanate, can be used alone or in admixture of two or more thereof.

Of these diisocyanate compounds, diphenylmethane-4, 4'-diisocyanate can be advantageously used in view of easy availability and cost.

The acid ingredient to be polymerized with the diisocyanate ingredient includes trimellitic acid, trimellitic acid anhydride, trimellitic acid chloride, and a tribasic acid as a derivative of trimellitic acid. Particularly, trimellitic acid anhydride can be advantageously used in view of easy availability and cost.

Further, the acid ingredient may also be partially incorporated, for example, with a tetracarboxylic acid anhydride or a dibasic acid, such as pyromellitic acid dianhydride, biphenyltetracarboxylic acid dianhydride, benzophenonetetracarboxylic acid dianhydride, diphenylsulfonetetracarboxylic acid dianhydride, terephthalic acid, isophthalic acid, sulfoterephthalic acid, dicitric acid, 2,5-thiophenedicarboxylic acid, 4,5-phenanthrenedicarboxylic acid, benzophenone-4,4'-dicarboxylic acid, phthaldiimidedicarboxylic acid, biphenyldicarboxylic acid, 2,6-naphthalenedicarboxylic acid, diphenylsulfone-4,4-dicarboxylic acid, and adipic acid.

The diamine ingredient of the polyamideimide prepared by the production method (2) includes those known diamines such as m-phenylenediamine, diaminodiphenylmethane, diaminodiphenylsulfone, diaminodiphenyl sulfide, diaminodiphenylpropane, diaminodiphenyl ether, diaminobenzophenone, diaminodiphenylhexafluoropropane, 4,4'-bis(4-aminophenoxy) biphenyl, 4,4'-[bis (4-aminophenoxy) biphenyl] ether, 4,4'-[bis (4-aminophenoxy) biphenyl] methane, 4,4'-[bis (4-aminophenoxy) biphenyl] sulfone, and 4,4'-[bis(4-aminophenoxy)biphenyl]propane. They can be used alone or in combination with two or more of them. Of these diamine compounds, diaminodiphenylmethane and diaminodiphenyl ether can be advantageously used in view of easy availability and cost.

The acid chloride ingredient of the polyamideimide prepared by the production method (3) includes trimellitic acid chloride and derivatives thereof. Further, terephthalic acid chloride and isophathalic acid chloride can also be added. As the diamine ingredient to be polymerized with the acid chloride ingredient, the same compounds as those exemplified in the production method (2) can be used.

Of the polyamideimides exemplified above, those preferred materials excellent in the adhesion to the conductor are polyamideimide as a reaction product of diphenylmethane-4, 4'-diisocyanate and trimellitic acid anhydride described above.

The polyimides exemplified above are made with diamine and anhydride acid components by publicly known polymerizing method. The polyimide made with diaminodiphenyl ether and pyromellitic acid anhydride is preferable according to the balance properties of cost and qualities.

For improving the adhesion of the first insulation layer (A) to the conductor, it is effective to add to the polyamideimide or polyimide a compound which can improve the adhesion between the insulation film and a metal by forming a complex with the metal.

Such a compound, which act as a metal inactivator, includes acetylenes such as hexane; alkynols such as propargyl alcohol and hexyneol; aldehydes such as benzaldehyde and cinnamic aldehyde; amines such as laurylamine, N, N'-dimethylamine, and trimethylcetylammonium bromide; mercaptans such as cetyl mercaptan, mercatoimidazole, and aminothiadiazole thiol; and thioureas such as thiourea and phenylthiourea. Of these, mercaptans are excellent in an effect of improving the adhesion and can be advantageously used.

The added amount of metal inactivator is preferably from 0.001 to 5 parts by weight based on 100 parts by weight of solid components (resin component excluding solvent) in the enamel. If the added amount of metal inactivator is less than 0.001 parts by weight, the effect of improving the adhesion of the insulation film to the metal by the addition is liable to be insufficient. On the contrary, if it exceeds 5 parts by weight, it is liable to adversely affect the conductor: such as denaturation or discoloration of the surface of the conductor, when the insulation coating is applied thereon.

The added amount of metal inactivator is more preferably from 0.005 to 1 part by weight in view of the effect of improving the adhesion and reduction of the influence on the conductor.

Further, for improving the adhesion of the insulation film to the conductor, it is also effective to add, to the polyamideimide or polyimide, an additive (for improvement of adhesion) such as polycarbodiimide resin, alkylphenyl formaldehyde resin, heterocyclic mercaptan, diepoxy silicone resin, novolak type polyglycidyl ether, melamine resin, benzoguanamine resin, alkoxy-modified amino resin, benzoazole and derivatives thereof, and trialkylamine. The additives can be used alone or combined with the metal inactivator described above.

The added amount of the additive for improving the adhesion is preferably from 0.01 to 10 parts by weight based on 100 parts by weight of the solid components in the enamel. If the added amount is less than 0.01 part by weight, the effect of improving the adhesion of the insulation film by the addition is liable to be insufficient. On the other hand, if it exceeds 10 parts by weight, the pot life of the enamel is liable to be short, and hence diminish the coatability.

The added amount of the additive is particularly preferably within a range from 0.05 to 2 parts by weight in view of the effect of improving the adhesion of the insulation film and the coatability.

In the enamel comprising each of the ingredients to be used for the first insulation layer (A) in this invention, various kinds of additives, for example, colorants such as a pigment or a dye, organic or inorganic fillers, and lubricants, may be added within a range not deteriorating the characteristics thereof.

Then, for the thermosetting resin (B1) constituting the second insulation layer (B), any thermosetting resin having a Tg of 250° C. or higher can be used.

Specific examples include polyamideimide, polyimide, polybenzimidazole, polyoxyimidazole, polyparabanic acid and aromatic polyamide. Of these, polyamideimide is preferred in view of cost and performance such as heat resistance and mechanical characteristics.

For the polyamideimide, the same resins as those used for the first insulation layer (A) can be used. Of these, the polyamideimide as the reaction product of diphenylmethane-4, 4'-diisocyanate and trimellitic acid anhydride as described above is particularly preferable.

Any thermoplastic resin can be used as the thermoplastic resin (B2) for the second insulation layer (B) provided that it has a Tg of 140° C. or higher and enables the resultant insulation film to have an elongation of 40% or more when it is blended with the resin (B1).

Specific examples include polyetherimide (about 220° C.), polyethersulfone (about 220° C.), polyether-ether ketone (about 145° C.), polyether ketone (about 155° C.), polysulfone (about 180° C.), polycarbonate (about 150° C.), aromatic polyester such as polyarylate (about 180° C.), aromatic polyamide (about 150° C.), and thermoplastic polyimide (about 260° C.). Values in the parentheses represent Tg values obtained by the differential scanning calorimetry (DSC).

Of these, polyetherimide and polyethersulfone are preferred, because when they are combined with the polyamide as the ingredient (B1), they are excellent in heat resistance and flexibility, particularly, flexibility when rolled into a flat wire. They are preferred in view of the cost as well. When a resin composition containing the polyamideimide or polyimide as the main ingredient is combined as the first insulation layer (A), a thus formed composite layer of the second insulation layer (B) and the first insulation layer (A) shows high elongation at break of the film and adhesion to the conductor and is also excellent in the heat resistance. Thus, it is particularly preferred.

The resin (B2) is preferably be mixed with the resin (B1) at a ratio within the range of 10 to 90% by weight in view of the heat resistance and flexibility. If the ratio of (B1) exceeds 90% by weight, the heat resistance is lowered. If it is below 10% by weight, the elongation of the insulation layer (B) is lowered. To maintain high heat resistance and film elongation, the ratio within a range of from 30 to 70% by weight is more preferred, a range from 35 to 55% by weight is further preferred, and a range from 35 to 45% by weight is particularly preferred.

As a method of mixing the resin (B1) and the resin (B2) to be contained in the second insulation layer (B), it is possible to adopt a method of dissolving the respective resins in solvents and mixing them; a method of simultaneously dissolving and mixing the respective resins in a solvent; a method of dissolving one of the resins in a solvent and then adding thereto and dissolving therein the other resin and mixing them; or a method of dissolving one of the resins and then synthesizing the other resin in the solution.

Further, in the second insulation layer (B), organic or inorganic fillers, pigments, dyes and lubricants can be added within a range not deteriorating the characteristics thereof.

When a polyamideimide is used for the resin of the first insulation layer (A) as well as for the resin (B1) of the second insulation layer (B), the adhesion between the two layers increases sufficiently to prevent interlayer peeling, thereby exhibiting the composite and synergistic effects between the layers also in the case where the resin (B2) for the second insulation layer (B) is added, which results in the improvement in the adhesion to the conductor and the flexibility as an entire insulation film.

In this case, when polyetherimide or polyethersulfone is mixed as the resin (B2) at a ratio from 10 to 90% by weight to the resin (B1), the entire insulation film can withstand a heat softening temperature of 400° C. or higher. However, the insulated wire of a single layered structure consisting of the second insulation layer (B) but not having the first insulation layer (A) cannot ensure sufficient heat resistance since the heat softening temperature is below 400° C.

The thickness of the film for the first insulation layer (A) and the second insulation layer (B) may be set to appropriate values depending on the use, shape and size of the insulated wire and, usually, it is within a range from 0.001 mm to 0.100 mm.

A film thickness ratio of the first insulation layer (A) to the second insulation layer (B) is preferably within a range from 5/95 to 40/60.

A film thickness ratio less than 5/95 is not preferred since the heat resistance (heat softening temperature) is lowered.

Further, if the film thickness ratio exceeds 40/60, it causes problems in the flexibility (bending property).

For providing the insulation film with high fabrication resistance, heat resistance, adhesion to the conductor and favorable weldability, the thickness ratio ($T_1/T_2$) of the thickness of the first insulation layer ($T_1$) to the thickness of the second insulation layer ($T_2$) is preferably within a range from 5/95 to 25/75 and, further preferably, from 10/90 to 20/80.

Both the first insulation layer (A) and the second insulation layer (B) may be a single layer or a plurality of layers having different constituent resin compositions.

For example, when the first insulation layer has a laminate structure, the thickness of each of the layers constituting the first insulation layer may be adjusted such that the total film thickness thereof and the thickness of the second insulation layer are within the range as described above. Also, when the second insulation layer has a laminate structure, the thickness for each of the layers constituting the second insulation layer may be adjusted such that the total film thickness thereof and the thickness of the first insulation layer are within the range as described above.

In the first and the second insulation layers, various kinds of additives, for example, colorants such as a pigment or a dye, inorganic or organic fillers and lubricants can be incorporated within a range not deteriorating the characteristics of the respective layers as described above.

The insulation film comprising the first and the second insulation layers may have a primer layer between the conductor and the first insulation layer, or have a surface lubrication layer above the second insulation layer, namely, at the uppermost layer of the insulation film.

Such surface lubrication layer is formed, for example, by coating a liquid paraffin or solid paraffin, forming a film of a lubricant such as wax, polyethylene, fluorocarbon resin or silicone resin directly on the second insulation layer, or forming a film thereof in a state welded with a binder resin having a film-forming property.

Further, the insulation film preferably has a residual amount of the solvent of 0.05% by weight or less based on the total amount of the insulation film.

If the residual amount of the solvent exceeds the above-mentioned range, the insulation film near the welded portion tends to cause blister by the heat of welding in the step of welding the terminal ends of the insulated wire to bring about a problem of deteriorating the weldability of the insulated wire even when the insulation film has good adhesion to the conductor and high heat resistance.

The residual amount of the solvent in the insulation film is preferably as low as possible within the above-mentioned range, and it is ideal that the amount is proximate to zero. Within the range described above, however, an insulated wire having favorable weldability not causing blister in the insulation film can be manufactured.

For controlling the residual amount of the solvent in the insulation film within the range described above, the insulated wire applied with the insulation film may be heat treated, for example, in an inert gas atmosphere such as nitrogen.

The conditions for the heat treatment are not particularly restricted, and it is preferred to apply heat treatment at 220° C. or higher for 5 hours or more. If the temperature is too low, or the time is too short, in the heat treatment, the heat treatment is insufficient and the residual amount of the solvent in the insulation film cannot be maintained at 0.05% by weight or less based on the total amount of the insulation film, so that the insulation film near the joined portion tends to cause blister by the heat of welding in the step of welding the terminal ends of the insulated wire, thereby possibly degrading the weldability of the insulated wire.

Further, in view of the flexibility of the insulation film, it is more desirable that the elongation at break is 50% or more.

As the conductor to be coated with the insulation film, various conductors used ordinarily for the insulated wires, for example, those made of copper or aluminum, can be used, and a conductor formed of a oxygen-free copper with an oxygen content of 10 ppm or less is particularly preferable.

When the conductor of the oxygen-free copper type is used, since the amount of a gas (oxygen) evolved from the conductor when heated by the heat of welding in the step of welding the terminal ends of the insulated wire can be decreased remarkably, blister in the insulation film on the conductor can be further suppressed to provide a merit capable of further improving the weldability of the insulated wire.

A manufacturing method for usual enamel wires can be coated to the round insulated wire (round wire) according to this invention, and the wire can be manufactured by coating and baking enamel forming the first insulation layer (A) and the second insulation layer (B), respectively.

It is particularly preferred for improving the space factor that a magnet wire (usually, round wire), which has been applied with the insulation film, is subjected to a rolling process so as to make a flat-shaped magnet wire.

In this case, the insulation film is excellent in the adhesion to the conductor and the flexibility according to the constitution of the invention as described above and, as a result, since the insulated wire according to this invention is excellent in resistance to rolling fabrication, it is not damaged by the rolling fabrication.

Further, the conventional insulated wires may sometimes cause a problem that they fail to satisfy a required flexibility when they have been formed into wires of flat square type even when they could satisfy such a flexibility in the form of a round type (round wire). However, since the insulated wire according to this invention is excellent in the adhesion to the conductor and the flexibility of the film, it keeps excellent flexibility even in the form of the flat wire. That is, the wire has excellent flexibility capable of withstanding the flexibility test similar to the round wire, keeps favorable adhesion to the conductor, is excellent in the resistivity to the winding fabrication even after the rolling fabrication, and is not damaged during wire winding.

Accordingly, this invention can provide a satisfactory flat wire free from the problem of deteriorating the electrical characteristics of equipment and lowering the production yield.

For rolling the wire into a flat type, a method of just rolling a round conductor, which has been applied with the insulation film, by a roller as it is, or a method of drawing the conductor through cassette roller dies to be adopted.

Specific embodiments of this invention are explained below with reference to the following Examples and Comparative Examples.

Methods for evaluation of various characteristics regarding the insulation film and the insulated wire according to the present invention are as follows.

(1) Adhesion of Insulation Film to Conductor

Two slits each of 2 cm in length were cut to an insulation film of a round wire along the longitudinal direction at 0.5 mm distance between them, and one end of the insulation film between the two slits was peeled off by a point of tweezers to conduct a 180°-peeling test between the insulation film and the conductor using a thermal-mechanical tester (TMA: thermal mechanical analyzer, manufactured by Seiko Instruments Inc.) to measure the adhesion of the film (g/mm).

(2) Tensile Test for Insulation Film

A conductor was removed from an insulated wire by etching, and the remaining insulation layer was pulled by a tensile tester under the conditions at a gauge length of 20 mm and at a tensile speed of 10 mm/min, to measure the elongation at break and the tensile strength of the insulation film.

(3) Flexibility Test for Insulated Wire (according to JIS C 3003-1984)

An insulated wire was tightly wound around a round bar of a predetermined diameter by 10 turns such that the wires were in contact with each other and examined by a test glass to check whether cracks that would expose the conductor through the insulation film were formed or not. In the case of a flat wire, a test for bending the wire in the longitudinal direction (i.e. bending with respect to the thickness) of the flat wire is referred to as a flatwise test and a test for bending the wire in the lateral direction thereof (i.e. bending with respect to the width) is referred to as an edgewise test. Round bars used had two kinds of diameter of 2 mm and 4 mm. The evaluation criteria for the flexibility test for Insulated Wire were as shown below.

○: no cracks to the insulation film (favorable flexibility)

Δ: partial crack (moderate flexibility)

X cracks (poor flexibility)

(4) Thermal Impact Resistance Test (according to JIS C 3003-1984)

Specimens of the insulated wire after the flexibility test were placed in a thermostatic chamber at 300° C. and kept for one hour and then examined by a test glass to check whether or not cracks exposing the conductor through the insulation film were observed. The evaluation criteria for the thermal impact resistance test were as shown below.

○: no cracks to the insulation film (favorable flexibility)

Δ: partial crack (moderate flexibility)

X : cracks (poor flexibility)

(5) Pinhole Test (according to JIS C 3003-1984)

Specimens of the insulated wires which had been subjected to the flexibility test were immersed in an 0.2% sodium chloride solution to which a suitable amount of a 3% phenolphthalein alcohol solution had been added, and a DC voltage at 12 V was applied, using the solution as a positive electrode and the specimen as a negative electrode for one minute, and the absence or presence of current flow was examined.

(6) Heat Softening Temperature (according to JIS C 3003-1984)

Two test specimens of insulated wire each of 15 cm in length were sampled. They were then placed overlapping each other at right angles on a flat plate, and a weight of 1 kg was placed on the overlapped portion, followed by placing them in a thermostatic chamber. AC voltage at 100 V having a waveform approximate to a sinusoidal wave at 50 or 60 Hz was applied between each of the conductors, the temperature was elevated in this state at a rate of about 2° C./min, and a temperature at which short circuit occurred was measured by setting thermocouple at a portion nearest to the specimen and the temperature was defined as the heat softening temperature. The short circuit current in this case was from 5 to 20 mA.

(7) Dielectric Break-Down Voltage Test

Specimens of the insulated wires which had been subjected to the dielectric break-down voltage (kV) test were measured in accordance with Japanese Industrial Standards JIS C 3003-1984 (test method for enamel coated copper wire and enamel coated aluminum wire).

(8) Measurement for Residual Amount of Solvent

After leaving insulated wires in a heating furnace at a furnace temperature of 350° C. for 3 minutes, gases evolved in the furnace were sampled and the amount of the solvent was determined quantitatively by a gas chromatograph (manufactured by GL Science Co.) and then the ratio based on the total amount of the insulation layer in the sample was calculated, which was determined as the residual amount of the solvent (wt %).

(9) Welding Test

An insulated wire of 150 mm length was sampled and the film was peeled 5 mm from both ends. While grounding one end to the earth, a welding torch was placed to the top end on the other end at 2 mm distance to cause arc discharge at 120 A for 0.2 seconds and the end of the insulated wire was melted. The weldability was evaluated based on the discoloration length (mm) of the insulation film and the absence or presence of blister in the insulation film near the melted portion. In the test, an Argon gas was caused to flow at about 15 liters per minute at the welded portion.

(Preparation of enamel used)

After polymerizing 192 g of trimellitic acid anhydride and 250 g of diphenylmethane-4, 4'-diisocyanate in an N-methyl-2-pyrrolidone solution by heating, xylene was added to prepare a polyamideimide enamel (a1) at 25% solids content. The N-methyl-2-pyrrolidone and xylene were blended such that the ratio in the enamel was 70:30.

Further, a polyamideimide enamel (a2) was prepared by adding 2 parts by weight of a polycarbodiimide resin (trade name: V-05, manufactured by Nisshinbo Industries, Inc.) to 100 parts by weight of the polyamideimide enamel (a1).

EXAMPLE 1

A copper wire conductor of 2 mmϕ was coated with a polyamideimide enamel (a1) as a first insulation layer (A) and baked by a conventional method such that the coating thickness was 0.001 mm, onto which a enamel which was prepared by dissolving 30 parts by weight of polyetherimide (ULTEM 1000, manufactured by Nippon GE Plastics) and 70 parts by weight of the polyamideimide (a1) in N-methyl-2-pyrrolidone so as to attain the resin component of 20% by weight was applied and baked to 0.04 mm thickness as a second insulation layer (B), to obtain an insulated wire having a overall diameter of 2.10 mm.

Further, the round wire thus obtained was drawn by rolling in a longitudinal direction and a lateral direction by passing through cassette roller dies, to obtain a flat wire. The conductor, the film thickness and the overall size are as shown in Table 1.

Tests were conducted for the adhesion of the insulation layer to the conductor, the tensile property of the insulation layer, the flexibility of the insulated wire, the thermal impact resistance, the pinhole and the heat softening temperature for the thus obtained round wires. Tests were also conducted on the flexibility of the insulated wire, the thermal impact resistance and the pinhole for the thus obtained flat wire. The results are shown in Table 1.

EXAMPLES 2, 3, 4 and 5

Using the same conductor and the insulation material as those in Example 1, round and flat wires were manufactured in the same manner as in Example 1 in which the mixing amount of polyamideimide and polyetherimide in the second insulation layer (B) was 50 parts by weight to 50 parts by weight for Example 2 and 30 parts by weight to 70 parts by weight for Example 3, 15 parts by weight to 85 parts by weight for Example 4, and 85 parts by weight to 15 parts by weight for Example 5, respectively. The characteristics were measured in a manner similar to that in Example 1 and are shown together with the sizes in Tables 1 and 2.

TABLE 1

| | | | Exam. 1 | Exam. 2 | Exam. 3 |
|---|---|---|---|---|---|
| Material for magnet wire (Tg) | Upper film material: Insulation layer (B) | | | | |
| | Polyamideimide (a1) (280° C.) | | 70 | 50 | 30 |
| | Polyetherimide (220° C.) | | 30 | 50 | 70 |
| | Lower film material: Insulation layer (A) | | | | |
| | Polyamideimide (a1) (280° C.) | | 100 | 100 | 100 |
| Round wire size before rolling | Overall diameter | mm | | 2.10 | |
| | Conductor diameter | mm | | 2.00 | |
| | Upper film thickness | mm | | 0.04 | |
| | Lower film thickness | mm | | 0.01 | |
| Round wire characteristics before rolling | Film adhesion | g/mm | 35 | 40 | 45 |
| | Film elongation at break | % | 55 | 60 | 60 |
| | Film tensile strength | kg/mm$^2$ | 12 | 11 | 11 |
| | Flexibility | 2 mmϕ | ○ | ○ | ○ |
| | Thermal impact resistance 300° C. × 1 h | 2 mmϕ | ○ | ○ | ○ |
| | Pinhole after 2 mmϕ bending | | None | None | None |
| | Heat softening temperature | ° C. | >400 | >400 | >400 |
| Flat wire size after rolling | Overall diameter | mm | | 1.48 × 2.28 | |
| | Conductor diameter | mm | | 1.40 × 2.20 | |
| | Film thickness | mm | | 0.04 × 0.04 | |
| Flat wire characteristics after rolling | Flexibility after rolling | | | | |
| | Flatwise | 2 mmϕ | ○ | ○ | ○ |
| | | 4 mmϕ | ○ | ○ | ○ |
| | Edgewise | 2 mmϕ | Δ | ○ | Δ |
| | | 4 mmϕ | ○ | ○ | ○ |
| | Thermal impact resistance 240° C. × 1 h | | | | |
| | Flatwise | 2 mmϕ | ○ | ○ | ○ |
| | | 4 mmϕ | ○ | ○ | ○ |
| | Edgewise | 2 mmϕ | Δ | ○ | Δ |
| | | 4 mmϕ | ○ | ○ | ○ |
| | Pinhole after 2 mmϕ bending | | None | None | None |
| Overall judgment | | | ○ | ○ | ○ |

Judgment criteria for flexibility:
○: no cracks, Δ: partially cracked, X: all cracked

TABLE 2

| | | | Exam. 4 | Exam. 5 |
|---|---|---|---|---|
| Material for magnet wire (Tg) | Upper film material: Insulation layer (B) | | | |
| | Polyamideimide (a1) (280° C.) | | 15 | 85 |
| | Polyetherimide (220° C.) | | 85 | 15 |
| | Lower film material: Insulation layer (A) | | | |
| | Polyamideimide (a1) (280° C.) | | 100 | 100 |
| Round wire size before rolling | Overall diameter | mm | 2.10 | |
| | Conductor diameter | mm | 2.00 | |
| | Upper film thickness | mm | 0.04 | |
| | Lower film thickness | mm | 0.01 | |
| Round wire characteristics before rolling | Film adhesion | g/mm | 40 | 35 |
| | Film elongation at break | % | 55 | 50 |
| | Film tensile strength | kg/mm$^2$ | 11 | 13 |
| | Flexibility | 2 mmϕ | ○ | ○ |
| | Thermal impact resistance 300° C. × 1 h | 2 mmϕ | ○ | ○ |
| | Pinhole after 2 mmϕ bending | | None | None |
| | Heat softening temperature | ° C. | >400 | >400 |
| Flat wire size after rolling | Overall diameter | mm | 1.48 × 2.28 | |
| | Conductor diameter | mm | 1.40 × 2.20 | |
| | Film thickness | mm | 0.04 × 0.04 | |
| Flat wire characteristics after rolling | Flexibility after rolling | | | |
| | Flatwise | 2 mmϕ | ○ | ○ |
| | | 4 mmϕ | ○ | ○ |
| | Edgewise | 2 mmϕ | X | X |
| | | 4 mmϕ | ○ | ○ |
| | Thermal impact resistance 240° C. × 1 h | | | |
| | Flatwise | 2 mmϕ | ○ | ○ |
| | | 4 mmϕ | ○ | ○ |
| | Edgewise | 2 mmϕ | X | X |

TABLE 2-continued

| | | Exam. 4 | Exam. 5 |
|---|---|---|---|
| | 4 mmϕ | ○ | ○ |
| Pinhole after 2 mmϕ bending | | Present | Present |
| Overall judgment | | ○ to Δ | ○ to Δ |

Judgment criteria for flexibility:
○: no cracks, Δ: partially cracked, X: all cracked

EXAMPLE 6

To a copper wire conductor of 2 mmϕ, the polyamideimide enamel (a1) was applied and baked to 0.001 mm thickness by a conventional method as the first insulation layer (A), on which a enamel was formed by adding 30 parts by weight of polyethersulfone (PES 300P, manufactured by Sumitomo Chemical Co., Ltd.) to 70 parts by weight of the polyamideimide enamel (a1) and dissolving in and diluting with N-methyl-2-pyrrolidone to 20% by weight of the resin component was applied and baked to 0.04 mm thickness as a second insulation layer (B), to obtain a round wire of 2.10 mm overall diameter. Further, the round wire was drawn by rolling in a longitudinal direction and a lateral direction by passing through a cassette roller dies, to obtain a flat wire. The conductor, the film thickness and the overall size are as shown in Table 3.

Tests were conducted for the adhesion of the insulation film to the conductor, the tensile property of the insulation film, the flexibility of the insulated wire, the thermal impact resistance, the pinhole and the heat softening temperature for the thus obtained round wires. Tests were also conducted on the flexibility of the insulated wire, the thermal impact resistance and the pinhole for the thus obtained flat wire. The results are shown in Table 3

EXAMPLES 7, 8, 9 and 10

Using the same conductor and the insulation material as those in Example 6, round and flat insulated wires were manufactured in the same manner as in Example 6 in which the mixing amount of polyamideimide and polyethersulfone in the second insulation layer (B) was 50 parts by weight to 50 parts by weight for Example 7, 30 parts by weight to 70 parts by weight for Example 8, 15 parts by weight to 85 parts by weight for Example 9, and 85 parts by weight to 15 parts by weight for Example 10, respectively. The same characteristics as those in Example 6 were measured and are shown together with the size in Tables 3 and 4.

TABLE 3

| | | | Exam. 6 | Exam. 7 | Exam. 8 |
|---|---|---|---|---|---|
| Material for magnet wire (Tg) | Upper film material: Insulation layer (B) | | | | |
| | Polyamideimide (a1) (280° C.) | | 70 | 50 | 30 |
| | Polyethersulfone (220° C.) | | 30 | 50 | 70 |
| | Lower film material: Insulation layer (A) | | | | |
| | Polyamideimide (a1) (280° C.) | | 100 | 100 | 100 |
| Round wire size before rolling | Overall diameter | mm | | 2.10 | |
| | Conductor diameter | mm | | 2.00 | |
| | Upper film thickness | mm | | 0.04 | |
| | Lower film thickness | mm | | 0.01 | |
| Round wire characteristics before rolling | Film adhesion | g/mm | 35 | 40 | 40 |
| | Film elongation at break | % | 60 | 70 | 65 |
| | Film tensile strength | kg/mm$^2$ | 12 | 11 | 10 |
| | Flexibility | 2 mmϕ | ○ | ○ | ○ |
| | Thermal impact resistance 300° C. × 1 h | 2 mmϕ | ○ | ○ | ○ |
| | Pinhole after 2 mmϕ bending | | None | None | None |
| | Heat softening temperature | ° C. | >400 | >400 | >400 |
| Flat wire size after rolling | Overall diameter | mm | | 1.48 × 2.28 | |
| | Conductor diameter | mm | | 1.40 × 2.20 | |
| | Upper film thickness | mm | | 0.03 × 0.03 | |
| | Lower film thickness | mm | | 0.01 × 0.01 | |
| Flat wire characteristics after rolling | Flexibility after rolling | | | | |
| | Flatwise | 2 mmϕ | ○ | ○ | ○ |
| | | 4 mmϕ | ○ | ○ | ○ |
| | Edgewise | 2 mmϕ | Δ | ○ | Δ |
| | | 4 mmϕ | ○ | ○ | ○ |
| | Thermal impact resistance 240° C. × 1 h | | | | |
| | Flatwise | 2 mmϕ | ○ | ○ | ○ |
| | | 4 mmϕ | ○ | ○ | ○ |
| | Edgewise | 2 mmϕ | Δ | ○ | Δ |
| | | 4 mmϕ | ○ | ○ | ○ |
| | Pinhole after 2 mmϕ bending | | None | None | None |
| Overall judgment | | | ○ | ○ | ○ |

Judgment criteria for flexibility:
○: no cracks, Δ: partially cracked, X: all

TABLE 4

| | | | Exam. 9 | Exam. 10 |
|---|---|---|---|---|
| Material for magnet wire (Tg) | Upper film material: Insulation layer (B) | | | |
| | Polyamideimide (a1) (280° C.) | | 15 | 85 |
| | Polyethersulfone (220° C.) | | 85 | 15 |
| | Lower film material: Insulation layer (A) | | | |
| | Polyamideimide (a1) (280° C.) | | 100 | 100 |
| Round wire size before rolling | Overall diameter | mm | 2.10 | |
| | Conductor diameter | mm | 2.00 | |
| | Upper film thickness | mm | 0.04 | |
| | Lower film thickness | mm | 0.01 | |
| Round wire characteristics before rolling | Film adhesion | g/mm | 40 | 35 |
| | Film elongation at break | % | 60 | 55 |
| | Film tensile strength | kg/mm$^2$ | 11 | 12 |
| | Flexibility | 2 mmϕ | ○ | ○ |
| | Thermal impact resistance 300° C. × 1 h | 2 mmϕ | ○ | ○ |
| | Pinhole after 2 mmϕ bending | | None | None |
| | Heat softening temperature | ° C. | >400 | >400 |
| Flat wire size after rolling | Overall diameter | mm | 1.48 × 2.28 | |
| | Conductor diameter | mm | 1.40 × 2.20 | |
| | Film thickness | mm | 0.04 × 0.04 | |
| Flat wire characteristics after rolling | Flexibility after rolling | | | |
| | Flatwise | 2 mmϕ | ○ | ○ |
| | | 4 mmϕ | ○ | ○ |
| | Edgewise | 2 mmϕ | X | X |
| | | 4 mmϕ | ○ | ○ |
| | Thermal impact resistance 240° C. × 1 h | | | |
| | Flatwise | 2 mmϕ | ○ | ○ |
| | | 4 mmϕ | ○ | ○ |
| | Edgewise | 2 mmϕ | X | X |
| | | 4 mmϕ | ○ | ○ |
| | Pinhole after 2 mmϕ bending | | Present | Present |
| Overall judgment | | | ○ to Δ | ○ to Δ |

Judgment criteria for flexibility:
○: no cracks, Δ: partially cracked, X: all cracked

COMPARATIVE EXAMPLES 1, 2 and 3

To a copper wire conductor of 2 mmϕ, the polyamideimide enamel (a1) used in Example 1 (Comparative Example 1), a enamel prepared by dissolving the polyetherimide used for the second insulation layer (3) in Example 1 in N-methyl-2-pyrrolidone to 20% by weight resin component (Comparative Example 2), and a polyimide enamel (trade name: ML enamel, manufactured by IST Co.) (Comparative Example 3) were respectively applied and baked to obtain round insulated wires. Further, flat wires were obtained from the round wires in the same manner as in Example 1. The size of the insulated wires and the results of the evaluation of characteristics are shown in Table 5.

COMPARATIVE EXAMPLES, 4, 5 and 6

Round and flat insulated wires were obtained in the same manner as in Example 1 except for using a polyetherimide enamel (manufactured by Nippon GE Plastics, a enamel prepared by dissolving ULUTEM 1000 in NM2P to 20% by weight) (Comparative Example 4), a polyimide enamel (trade name of products: ML enamel, manufactured by IST Co.) (Comparative Example 5) and a polyesterimide enamel (ISOMID40SH, manufactured by Nisshoku Schenectudy Co.) as the first insulation layer (A) and the enamel used in Example 2 as the second insulation layer (B). The size of the insulated wires and the results for the evaluation of characteristics are shown in Table 6.

COMPARATIVE EXAMPLES 7 and 8

Round and flat insulated wires were obtained in the same manner as in Example 1 except for using the polyamideimide enamel (a1) as the first insulation layer (A), the polyesterimide enamel used in Example 5 as the second insulation layer (B) (Comparative Example 7) and the polyetherimide used in Comparative Example 4 (Comparative Example 8), respectively. The size of the insulated wires and the results for the evaluation of the characteristics are shown in Table 7.

TABLE 5

| | | | Comp. Exam. 1 | Comp. Exam. 2 | Comp. Exam. 3 |
|---|---|---|---|---|---|
| Material for magnet wire (Tg) | Film material | | | | |
| | Polyamideimide (a1) (280° C.) | | 100 | 0 | 0 |
| | Polyetherimide (220° C.) | | 0 | 100 | 0 |
| | Polyimide (400° C. or higher) | | 0 | 0 | 100 |
| Round wire size before rolling | Overall diameter | mm | | 2.10 | |
| | Conductor diameter | mm | | 2.00 | |
| | Film thickness | mm | | 0.05 | |
| Round wire characteristics before rolling | Film adhesion | g/mm | 35 | 5 | 25 |
| | Film elongation at break | % | 35 | 30 | 65 |
| | Film tensile strength | kg/mm$^2$ | 14 | 11 | 18 |
| | Flexibility | 2 mmφ | ○ | ○ | ○ |
| | Thermal impact resistance 300° C. × 1 h | 2 mmφ | ○ | ○ | ○ |
| | Pinhole after 2 mmφ bending | | None | None | None |
| | Heat softening temperature | ° C. | >400 | 360 | >400 |
| Flat wire size after rolling | Overall diameter | mm | | 1.48 × 2.28 | |
| | Conductor diameter | mm | | 1.40 × 2.20 | |
| | Film thickness | mm | | 0.04 × 0.04 | |
| Flat wire characteristics after rolling | Flexibility after rolling | | | | |
| | Flatwise | 2 mmφ | X | X | X |
| | | 4 mmφ | ○ | X | ○ |
| | Edgewise | 2 mmφ | X | X | X |
| | | 4 mmφ | X | X | ○ |
| | Thermal impact resistance 240° C. × 1 h | | | | |
| | Flatwise | 2 mmφ | X | X | X |
| | | 4 mmφ | ○ | X | ○ |
| | Edgewise | 2 mmφ | X | X | X |
| | | 4 mmφ | ○ | X | X |
| | Pinhole after 2 mmφ bending | | Present | Present | Present |
| Overall judgment | | | X | X | X |

Judgment criteria for flexibility:
○: no cracks, Δ: partially cracked, X : all cracked

TABLE 6

| | | | Comp. Exam. 4 | Comp. Exam. 5 | Comp. Exam. 6 |
|---|---|---|---|---|---|
| Material for magnet wire (Tg) | Upper film material: Insulation layer (B) | | | | |
| | Polyamideimide (a1) (280° C.) | | 50 | 50 | 50 |
| | Polyetherimide (220° C.) | | 50 | 50 | 50 |
| | Lower film material: Insulation layer (A) | | | | |
| | Polyetherimide (220° C.) | | 100 | 0 | 0 |
| | Polyimide (400° C. or higher) | | 0 | 100 | 0 |
| | Polyesterimide (180° C.) | | 0 | 0 | 100 |
| Round wire size before rolling | Overall diameter | mm | | 2.10 | |
| | Conductor diameter | mm | | 2.00 | |
| | Upper film thickness | mm | | 0.04 | |
| | Lower film thickness | mm | | 0.01 | |
| Round wire characteristics before rolling | Film adhesion | g/mm | 10 | 25 | 55 |
| | Film elongation at break | % | 50 | 60 | 30 |
| | Film tensile strength | kg/mm$^2$ | 11 | 13 | 10 |
| | Flexibility | 2 mmφ | ○ | ○ | ○ |
| | Thermal impact resistance 300° C. × 1 h | 2 mmφ | ○ | ○ | ○ |
| | Pinhole after 2 mmφ bending | | None | None | None |
| | Heat softening temperature | ° C. | 370 | >400 | 360 |
| Flat wire size after rolling | Overall diameter | mm | | 1.48 × 2.28 | |
| | Conductor diameter | mm | | 1.40 × 2.20 | |
| | Film thickness | mm | | 0.04 × 0.04 | |
| Flat wire characteristics after rolling | Flexibility after rolling | | | | |
| | Flatwise | 2 mmφ | X | ○ | X |
| | | 4 mmφ | ○ | ○ | ○ |
| | Edgewise | 2 mmφ | X | X | X |
| | | 4 mmφ | ○ | ○ | X |
| | Thermal impact resistance 240° C. × 1 h | | | | |
| | Flatwise | 2 mmφ | X | ○ | X |
| | | 4 mmφ | ○ | ○ | X |
| | Edgewise | 2 mmφ | X | X | X |
| | | 4 mmφ | ○ | ○ | X |
| | Pinhole atter 2 mmφ bending | | Present | Present | Present |
| Overall judgment | | | X | X | X |

Judgment criteria for flexibility:
○: no cracks, Δ: partially cracked, X: all cracked

TABLE 7

| | | | Comp. Exam. 7 | Comp. Exam. 8 |
|---|---|---|---|---|
| Material for magnet wire (Tg) | Upper film material: Insulation layer (13) | | | |
| | Polyesterimide (180° C.) | | 100 | 0 |
| | Polyetherimide (220° C.) | | 0 | 100 |
| | Lower film material: Insulation layer (A) | | | |
| | Polyamideimide (a1) (280° C.) | | 100 | 100 |
| Round wire size before rolling | Overall diameter | mm | 2.10 | |
| | Conductor diameter | mm | 2.00 | |
| | Upper film thickness | mm | 0.04 | |
| | Lower film thickness | mm | 0.01 | |

TABLE 7-continued

| | | | Comp. Exam. 7 | Comp. Exam. 8 |
|---|---|---|---|---|
| Round wire characteristics before rolling | Film adhesion | g/mm | 40 | 40 |
| | Film elongation at break | % | 20 | 40 |
| | Film tensile strength | kg/mm$^2$ | 13 | 11 |
| | Flexibility | 2 mmφ | ○ | ○ |
| | Thermal impact resistance 300° C. × 1 h | 2 mmφ | ○ | ○ |
| | Pinhole after 2 mmφ bending | | None | None |
| | Heat softening temperature | ° C. | >400 | >400 |
| Flat wire size after rolling | Overall diameter | mm | 1.48 × 2.28 | |
| | Conductor diameter | mm | 1.40 × 2.20 | |
| | Film thickness | mm | 0.04 × 0.04 | |
| Flat wire characteristics after rolling | Flexibility after rolling | | | |
| | Flatwise | 2 mmφ | X | X |
| | | 4 mmφ | X | ○ |
| | Edgewise | 2 mmφ | X | X |
| | | 4 mmφ | X | ○ |
| | Thermal impact resistance 240° C. × 1 h | | | |
| | Flatwise | 2 mmφ | X | X |
| | | 4 mmφ | X | ○ |
| | Edgewise | 2 mmφ | X | X |
| | | 4 mmφ | X | ○ |
| | Pinhole after 2 mmφ bending | | Present | Present |
| Overall judgment | | | X | X |

Judgment criteria for flexibility:
○: no cracks, Δ: partially cracked, X: all cracked

EXAMPLES 11 and 12

Round and flat wires were obtained in the same manner as in Example 2 (Example 11) and Example 7 (Example 12) except for using the polyamideimide enamel (a2) as the first insulation layer (A). The size of the insulated wires and the results of the evaluation of characteristics are shown in Table 8.

EXAMPLES 13, 14, 15, 16 and 17

Using the same conductor and the insulation material as those in Example 1, round and flat insulated wires were manufactured in the same manner as in Example 1, in which the mixing amount of the polyamideimide (a1) and polyetherimide in the second insulation layer (B) was 65 parts by weight to 35 parts by weight for Example 13, 60 parts by weight to 40 parts by weight for Example 14, 55 parts by weight to 45 parts by weight for Example 15, 45 parts by weight to 55 parts by weight for Example 16, and 40 parts by weight to 60 parts by weight for Example 17, respectively. The same characteristics as those in Example 1 were measured and are shown together with the size in Tables 9 and 10.

TABLE 8

| | | | Exam. 11 | Exam. 12 |
|---|---|---|---|---|
| Material for magnet wire (Tg) | Upper film material: Insulation layer (B) | | | |
| | Polyamideimide (al) (280° C.) | | 50 | 50 |
| | Polyetherimide (220° C.) | | 50 | 0 |
| | Polyethersulfone (220° C.) | | 0 | |
| | Lower film material: Insulation layer (A) | | | |
| | Polyamideimide (a2) (280° C.) | | 100 | 100 |
| Round wire size before rolling | Overall diameter | mm | 2.10 | |
| | Conductor diameter | mm | 2.00 | |
| | Upper film thickness | mm | 0.04 | |
| | Lower film thickness | mm | 0.01 | |
| Round wire characteristics before rolling | Film adhesion | g/mm | 70 | 65 |
| | Film elongation at break | % | 65 | 60 |
| | Film tensile strength | kg/mm$^2$ | 11 | 11 |
| | Flexibility | 2 mmφ | ○ | ○ |
| | Thermal impact resistance 300° C. × 1 h | 2 mmφ | ○ | ○ |
| | Pinhole after 2 mmφ bending | | None | None |
| | Heat softening temperature | ° C. | >400 | >400 |
| Flat wire size after rolling | Overall diameter | mm | 1.48 × 2.28 | |
| | Conductor diameter | mm | 1.40 × 2.20 | |
| | Film thickness | mm | 0.04 × 0.04 | |
| Flat wire characteristics after rolling | Flexibility after rolling | | | |
| | Flatwise | 1.5 mmφ | ○ | ○ |
| | | 2 mmφ | ○ | ○ |
| | Edgewise | 1.5 mmφ | ○ | ○ |
| | | 2 mmφ | ○ | ○ |
| | Thermal impact resistance 240° C. × 1 h | | | |
| | Flatwise | 1.5 mmφ | ○ | ○ |
| | | 2 mmφ | ○ | ○ |
| | Edgewise | 1.5 mmφ | ○ | ○ |
| | | 4 mmφ | ○ | ○ |
| | Pinhole after 2 mmφ bending | | None | None |
| Overall judgment | | | ○ | ○ |

Judgment criteria for flexibility:
○: no cracks, Δ: partially cracked, X: all cracked

TABLE 9

| | | | Exam. 13 | Exam. 14 | Exam. 15 |
|---|---|---|---|---|---|
| Material for magnet wire (Tg) | Upper film material: Insulation layer (B) | | | | |
| | Polyamideimide (al) (280° C.) | | 65 | 60 | 55 |
| | Polyetherimide (220° C.) | | 35 | 40 | 45 |
| | Lower film material: Insulation layer (A) | | | | |
| | Polyamideimide (al) (280° C.) | | 100 | 100 | 100 |
| Round wire size before rolling | Overall diameter | mm | | 2.10 | |
| | Conductor diameter | mm | | 2.00 | |
| | Upper film thickness | mm | | 0.04 | |
| | Lower film thickness | mm | | 0.01 | |
| Round wire characteristics before rolling | Film adhesion | g/mm | 35 | 40 | 45 |
| | Film elongation at break | % | 55 | 60 | 60 |
| | Film tensile strength | kg/mm$^2$ | 12 | 11 | 11 |
| | Flexibility | 2 mmφ | ○ | ○ | ○ |
| | Thermal impact resistance 300° C. × 1 h | 2 mmφ | ○ | ○ | ○ |
| | Pinhole after 2 mmφ bending | | None | None | None |
| | Heat softening temperature | ° C. | >400 | >400 | >400 |
| Flat wire size after rolling | Overall diameter | mm | | 1.48 × 2.28 | |
| | Conductor diameter | mm | | 1.40 × 2.20 | |
| | Film thickness | mm | | 0.04 × 0.04 | |
| Flat wire characteristics after rolling | Flexibility after rolling | | | | |
| | Flatwise | 2 mmφ | ○ | ○ | ○ |
| | | 4 mmφ | ○ | ○ | ○ |
| | Edgewise | 2 mmφ | ○ | ○ | ○ |
| | | 4 mmφ | ○ | ○ | ○ |
| | Thermal impact resistance 240° C. × 1 h | | | | |
| | Flatwise | 2 mmφ | ○ | ○ | ○ |
| | | 4 mmφ | ○ | ○ | ○ |
| | Edgewise | 2 mmφ | ○ | ○ | ○ |
| | | 4 mmφ | ○ | ○ | ○ |

TABLE 9-continued

| | Exam. 13 | Exam. 14 | Exam. 15 |
|---|---|---|---|
| Pinhole after 2 mmϕ bending | None | None | None |
| Overall judgment | ○ | ○ | ○ |

Judgment criteria for flexibility:
○: no cracks, Δ: partially cracked, X: all

TABLE 10

| | | | Exam. 16 | Exam. 17 |
|---|---|---|---|---|
| Material for magnet wire (Tg) | Upper film material: Insulation layer (B) | | | |
| | Polyamideimide (al) (280° C.) | | 45 | 40 |
| | Polyetherimide (220° C.) | | 55 | 60 |
| | Lower film material: Insulation layer (A) | | | |
| | Polyamideimide (al) (280° C.) | | 100 | 100 |
| Round wire size before rolling | Overall diameter | mm | 2.10 | |
| | Conductor diameter | mm | 2.00 | |
| | Upper film thickness | mm | 0.04 | |
| | Lower film thickness | mm | 0.01 | |
| Round wire characteristics before rolling | Film adhesion | g/mm | 40 | 35 |
| | Film elongation at break | % | 55 | 50 |
| | Film tensile strength | kg/mm$^2$ | 11 | 13 |
| | Flexibility | 2 mmϕ | ○ | ○ |
| | Thermal impact resistance 300° C. × 1 h | 2 mmϕ | ○ | ○ |
| | Pinhole after 2 mmϕ bending | | None | None |
| | Heat softening temperature | ° C. | >400 | >400 |
| Flat wire size after rolling | Overall diameter | mm | 1.48 × 2.28 | |
| | Conductor diameter | mm | 1.40 × 2.20 | |
| | Film thickness | mm | 0.04 × 0.04 | |
| Flat wire characteristics after rolling | Flexibility after rolling | | | |
| | Flatwise | 2 mmϕ | ○ | ○ |
| | | 4 mmϕ | ○ | ○ |
| | Edgewise | 2 mmϕ | ○ | ○ |
| | | 4 mmϕ | ○ | ○ |
| | Thermal impact resistance 240° C. × 1 h | | | |
| | Flatwise | 2 mmϕ | ○ | ○ |
| | | 4 mmϕ | ○ | ○ |
| | Edgewise | 2 mmϕ | ○ | Δ |
| | | 4 mmϕ | ○ | ○ |
| | Pinhole after 2 mmϕ bending | | None | None |
| Overall judgment | | | ○ | ○ |

Judgment criteria for flexibility:
○: no cracks, Δ: partially cracked, ×: all

EXAMPLE 18

On a round wire shaped conductor of 2 mmϕ in diameter formed of oxygen-free copper with an oxygen content of 3 ppm, a polyamideimide enamel (a trade name: HI-400, manufactured by Hitachi Chemical Co., Ltd., resin content: 25 wt %) as a enamel for the first insulation layer was at first applied and baked to form a coating of a layer thickness, $T_1$=0.01 mm.

Then, a mixture of a enamel for a second insulation layer prepared by mixing 240 parts by weight of the same polyamideimide enamel as described above (a trade name: HI-400, manufactured by Hitachi Chemical Co., Ltd.) and 40 parts by weight of a polyetherimide (a trade name: ULUTEM 1000, manufactured by Nippon GE Plastics, glass transition temperature: 220° C.) as a thermoplastic resin and diluting with N-methyl-2-pyrrolidone to the entire resin content of 20% by weight [mixing ratio (weight ratio) of the polyamideimide (B1) and the thermoplastic resin (polyetherimide) (B2) contained in the enamel: B1/B2=60/40] was applied and baked also by the conventional method on the first insulation layer, to laminate a cover of the second insulation layer at a thickness, $T_2$=0.04 mm, thereby forming an insulation film of a two-layered structure.

The ratio for the thickness of both of the insulation layers was $T_1/T_2$=20/80. The overall diameter at this step was 2.0 mm.

Then, the conductor covered and formed with the insulation film as described above was rolled in the longitudinal direction and the lateral direction by passing and drawing in a cassette roller dies and, subsequently, heat treated in nitrogen at 240° C. for 6 hours, to manufacture a flat wire as an insulated wire.

EXAMPLES 19 to 26

Flat wires as the insulated wires were manufactured in the same manner as in Example 18 except for controlling the mixing amount of the polyetherimide to the polyamideimide enamel such that the mixing ratio (weight ratio) B1/B2 between the polyamideimide (B1) and the thermoplastic resin (polyetherimide) (B2) in the enamel for the second insulation layer was 85/15(EXAMPLE 19), 70/30 (Example 20), 65/35 (Example 21), 55/45 (Example 22), 50/50 (Example 23), 40/60 (Example 24), 30/70(Example 25), and 15/85 (Example 26), respectively.

EXAMPLES 27 and 28

Flat wires as the insulated wires were manufactured in the same manner as in Example 18 except for changing the conditions for the heat treatment to 200° C. for 6 hours (Example 27), and 220° C. for 6 hours (Example 28), respectively.

EXAMPLE 29

A flat wire as the insulated wire was manufactured in the same manner as Example 1 except for using a round bar-shaped conductor of 2 mmϕ in diameter formed of tough pitch copper with an oxygen content of 200 ppm as the conductor.

COMPARATIVE EXAMPLE 9

A flat wire as the insulated wire was manufactured in the same manner as in Example 18 except for coating and baking the polyamideimide enamel by the conventional method on the same conductor as used in Example 18 to form a coating of an insulation film of a single-layered structure with 0.05 mm thickness.

COMPARATIVE EXAMPLE 10

A flat wire as the insulated wire was manufactured in the same manner as in Example 18 except for coating and baking the enamel for the second insulation layer prepared in Example 18 by the conventional method on the same conductor as used in Example 18 to form a coating of an insulation film of a single-layered structure with 0.05 mm thickness.

EXAMPLE 30

A flat wire as the insulated wire was manufactured in the same manner as in Example 18 except for changing the thickness of the first insulation layer to $T_1$=0.005 mm and the thickness of the second insulation layer to $T_2$=0.045 mm, and the ratio for the thickness of both of the insulation film to $T_1/T_2$=10/90.

EXAMPLE 31

A flat wire as the insulated wire was manufactured in the same manner as in Example 18 except for changing the thickness of the first insulation layer to $T_1$=0.015 mm and the thickness of the second insulation layer to: $T_2$=0.035 mm, and the ratio for the thickness of both of the insulation film to $T_1/T_2$=30/70.

EXAMPLE 32

A flat wire as the insulated wire was manufactured in the same manner as in Example 31 except for changing the thickness of the first insulation layer to $T_1$=0.025 mm and the thickness of the second insulation layer to: $T_2$=0.025 mm, and the ratio for the thickness of both of the insulation film to $T_1/T_2$=50/50.

EXAMPLE 33

A flat wire as the insulated wire was manufactured in the same manner as in Example 1 except for changing the insulation material of the insulation layer (A) from polyamideimide to polyimide "Pyre ML" manufactured by IST. The same characteristics as in Example 1 were tested, and the results are shown in Table 13.

For the insulated wires (flat wires) manufactured in Examples 18 to 33 and Comparative Examples 9 and 10, tests on the measurement of the residual amount of solvent, tensile test, weldability test and general characteristics test were conducted, respectively, and the results are shown in Tables 11 to 14.

The adhesion of the insulation film to the conductor was 30 g/mm or more in each of the Examples 18 to 33.

TABLE 11

| | | Exam. 18 | Exam. 19 | Exam. 20 | Exam. 21 | Exam. 22 | Exam. 23 |
|---|---|---|---|---|---|---|---|
| Insulation film | First insulation layer $T_1$(mm) | 0.01 | 0.01 | 0.01 | 0.01 | 0.01 | 0.01 |
| | Second insulation layer $B_1/B_2$ | 60/40 | 85/15 | 70/30 | 65/35 | 55/45 | 50/50 |
| | $T_2$(mm) | 0.04 | 0.04 | 0.04 | 0.04 | 0.04 | 0.04 |
| | $T_1/T_2$ | 20/80 | 20/80 | 20/80 | 20/80 | 20/80 | 20/80 |
| | Residual amount of solvent (% by weight) | 0.003 | 0.005 | 0.005 | 0.004 | 0.003 | 0.003 |
| Oxygen content in conductor (ppm) | | 3 | 3 | 3 | 3 | 3 | 3 |
| Elongation at break (%) | | 60 | 45 | 50 | 55 | 65 | 65 |
| Weldability | Discoloration length (mm) | 20 | 17 | 16 | 18 | 22 | 30 |
| | Blister in insulation film | None | Foamed greatly | None | None | None | None |
| General characteristics | Edgewise 2 mm | ○ | X | Δ | ○ | ○ | ○ |
| | Flatwise 2 mm | ○ | ○ | ○ | ○ | ○ | ○ |
| | Heat softening temperature (° C.) | 410 | 430 | 425 | 415 | 400 | 410 |
| | Insulation breakdown voltage (kV) | 7.1 | 7.1 | 7 | 7.3 | 7 | 7.1 |

TABLE 12

| | | Exam. 24 | Exam. 25 | Exam. 26 | Exam. 27 | Exam. 28 | Exam. 29 |
|---|---|---|---|---|---|---|---|
| Insulation film | First insulation layer $T_1$(mm) | 0.01 | 0.01 | 0.001 | 0.01 | 0.01 | 0.01 |
| | Second insulation layer $B_1/B_2$ | 40/60 | 30/70 | 15/85 | 60/40 | 60/40 | 60/40 |
| | $T_2$(mm) | 0.04 | 0.04 | 0.04 | 0.04 | 0.04 | 0.04 |
| | $T_1/T_2$ | 20/80 | 20/80 | 20/80 | 20/80 | 20/80 | 20/80 |
| | Residual amount of solvent (% by weight) | 0.002 | 0.003 | 0.002 | 0.01 | 0.03 | 0.0032 |
| Oxygen content in conductor (ppm) | | 3 | 3 | 3 | 3 | 3 | 200 |
| Elongation at break (%) | | 60 | 55 | 40 | 60 | 60 | 60 |
| Weldability | Discoloration length (mm) | 35 | 40 | 50 | 21 | 20 | 20 |
| | Blister in insulation film | None | None | None | Foamed greatly | Foamed slightly | Foamed slightly |
| | Edgewise 2 mm | ○ | ○ | X | ○ | ○ | ○ |
| General characteristics | Flatwise 2 mm | ○ | ○ | ○ | ○ | ○ | ○ |
| | Heat softening temperature (° C.) | 380 | 400 | 380 | 415 | 410 | 410 |
| | Insulation breakdown voltage (kV) | 7.2 | 7 | 7 | 6.9 | 7.4 | 7.3 |

TABLE 13

| | | Exam. 30 | Exam. 31 | Exam. 32 | Exam. 33 |
|---|---|---|---|---|---|
| Insulation film | First insulation layer $T_1$(mm) | 0.005 | 0.015 | 0.025 | Polyimide 0.01 |
| | Second insulation layer $B_1/B_2$ | 60/40 | 60/40 | 60/40 | 60/40 |
| | $T_2$(mm) | 0.045 | 0.025 | 0.035 | 0.04 |
| | $T_1/T_2$ | 10/90 | 30/70 | 50/50 | 20/80 |
| | Residual amount of solvent (% by weight) | 0.002 | 0.005 | 0.006 | 0.005 |
| Oxygen content in conductor (ppm) | | 3 | 3 | 3 | 3 |
| Elongation at break (%) | | 60 | 50 | 45 | 70 |
| Weldability | Discoloration length (mm) | 23 | 18 | 17 | 15 |
| | Blister in insulation film | None | Foamed very slightly | Foamed slightly | None |
| General characteristics | Edgewise 2 mm | ○ | Δ | X | ○ |
| | Flatwise 2 mm | ○ | ○ | ○ | ○ |
| | Heat softening temperature (° C.) | 410 | 415 | 420 | higher than 500 |
| | Insulation breakdown voltage (KV) | 6.8 | 7.4 | 7.1 | 7.5 |

TABLE 14

| | | Comp. Exam. 9 | Comp. Exam. 10 |
|---|---|---|---|
| Insulation film | First insulation layer $T_1$(mm) | Polyamide-imide single-layered structure | $B_1/B_2$ 60/40 single-layered structure |
| | Second insulation layer $B_1/B_2$ | | |
| | $T_2$(mm) | | |
| | $T_1/T_2$ | | |
| | Residual amount of solvent (% by weight) | 0.007 | 0.002 |
| Oxygen content in conductor (ppm) | | 3 | 3 |
| Elongation at break (%) | | 30 | 65 |
| Weldability | Discoloration length (mm) | 10 | 40 |
| | Blister in insulation film | Foamed greatly | None |
| General characteristics | Edgewise 2 mm | X | ○ |
| | Flatwise 2 mm | X | ○ |
| | Heat softening temperature (□) | 420 | 350 |
| | Insulation breakdown voltage (kV) | 7 | 7.1 |

(Consideration on Examples 1 to 17 and Comparative Examples 1 to 8)

From the results of Examples 1 to 17 and Comparative Examples 1 to 8, it can be seen that use of the insulated wires according to this invention enables to provide insulated wires with excellent flexibility also after being rolled into flat wires while maintaining the heat resistance.

Referring more specifically, as can be seen from Examples 1 to 17, insulated wires excellent in the heat resistance (heat softening temperature) and satisfactory in view of the flexibility also after being rolled into flat wires can be obtained by satisfying the conditions of (1) forming an insulation film having a Tg of 250° C. or higher and an adhesion to the conductor of 30 g/mm or more as the first insulation layer (A) for the lower film material, (2) forming a second insulation layer (B) comprising, as the main ingredient, a resin prepared by mixing from 10 to 90% of a resin having a Tg of 140° C. or higher with a resin having a Tg of 250° C. or higher as the upper film material, and (3) defining the elongation at break of 40% or more and the adhesion to the conductor of 30 g/mm$^2$ or more in the insulation film comprising the first insulation layer (A) and the second insulation layer (B).

Examples 1 to 3, Examples 6 to 8 and Examples 13 to 17 are examples, in which the polyamideimide is used for the first insulation layer (A), and polyetherimide or polyethersulfone (B2) is mixed within a range from 30 to 70% by weight with the polyamideimide (B1) as the second insulation layer (B), and they show particularly excellent characteristics in round wires and flat wires.

In Examples 4 and 5 and Examples 9 and 10, the mixing ratio of (B2) to (B1) is within the range from 10 to 90% by weight but without the range from 30 to 70% by weight. Although the characteristics of the round wires are excellent, cracking occasionally occurs in the edgewise test and the flexibility test for flat wires and they are at acceptable levels (○ to Δ) as the overall judgment.

Examples 11 and 12 contain the polycarbodiimide resin in the first insulation layer (A), so that they show high adhesion of the film and maintain sufficient values for film elongation, and both of the round wires and flat wires have excellent characteristics.

On the other hand, Comparative Examples 1 to 3 show cases having a single layer of insulation film but they are poor in the balance of the elongation at break and the adhesion of the film, and the flexibility is degraded and pinholes occur in the flat wires rolled from the round wires.

Comparative Examples 4 and 6 satisfy the condition (2) for the upper film material but do not satisfy the condition (1) for the lower film material, so that the heat softening temperature is below 400° C., and the heat resistance is insufficient. Further, since the adhesion or elongation at break of the composite film of the first insulation layer (A) and the second insulation layer (B) does not satisfy the condition (3) above, the flexibility of the flat wire is also deteriorated.

Comparative Example 5 satisfies the conditions (1) and (2) above but is insufficient in the adhesion in (3), so that cracking occurs in the flexibility test after being rolled into the flat wire.

Comparative Examples 7 and 8 satisfy the condition (1) for the lower film material, but since the upper film does not satisfy the condition (2), elongation at break (3) of the film is insufficient and the flexibility of the flat wires is insufficient.

As described above, it is necessary to satisfy the film conditions (1), (2) and (3) of this invention for making the heat resistance of the insulation material and the flexibility of the flat wire compatible.

(Consideration on Examples 18 to 33 and Comparative Examples 9 and 10)

As shown in Table 14, it has been found that Comparative Example 9 in which a single-layered insulation film is formed of the polyamideimide enamel is poor in the flexibility and Comparative Example 10 in which an insulation film of a single-layered structure is formed of the enamel for the second insulation layer (B1/B2=60/40) is insufficient in the heat resistance.

On the contrary, Examples 18 to 33 having the two-layered structure of this invention are excellent both in the heat resistance and the flexibility.

Then, Examples 18 to 28 are to be compared with each other.

As shown in Table 12, it has been found that Example 24 in which the blending ratio of the thermoplastic resin in the second insulation layer is 15% although having an insulation film of the two-layered structure comprising the first and the second insulation layers is somewhat deteriorated in the flexibility and, contrarily, that Example 25 in which the blending ratio of the thermoplastic resin is 85% is somewhat deteriorated in the flexibility and heat resistance.

As shown in Table 13, it has been found that Example 32 in which the thickness of the first insulation layer is relatively large with a thickness ratio between the first and the second insulation layers of 50/50 is deteriorated in the flexibility and the weldability.

Accordingly, the thickness ratio for the first and the second insulation layers is preferably from 5/95 to 40/60.

On the contrary, it has been confirmed that Examples 18, and 20 to 25 in which the blending ratio of the thermoplastic resin (B2) in the second insulation layer is from 30 to 70% by weight and the thickness ratio $T_1/T_2$ between the first and the second insulation layers is within a range of from 5/95 to 40/60 are excellent in the fabrication resistance upon rolling into flat wires, as well as are satisfactory in the flexibility and the heat resistance after fabrication as shown in Tables 11 and 13.

Also it can be seen as shown in Table 13, that if the residual amount of the solvent in the insulation film is large as in Examples 27 and 28 in which the residual amount of the solvent exceeds 0.05% by weight, the weldability is lowered.

Accordingly, in view of the weldability, the residual amount of the solvent in the insulation film is preferably 0.05% by weight or less.

Furthermore, when Examples 18 to 26, and 29 are compared with each other, it has been found that the blending ratio of the thermoplastic resin (B2) in the second insulation layer is preferably from 35 to 65% by weight in view of the flexibility and the weldability and the oxygen concentration in the conductor is preferably 10 ppm or less also in view of the weldability.

What is claimed is:

1. An insulated wire, which comprises a conductor, a first insulation layer formed on the conductor, and a second insulation layer formed on the first insulation layer, the first insulation layer comprising a thermosetting resin having a glass transition temperature of 250° C. or higher as a main ingredient, and the second insulation layer comprising a resin, as a main ingredient, formed by mixing a thermosetting resin having a glass transition temperature of 250° C. or higher with 10 to 90% by weight of a thermoplastic resin having a glass transition temperature of 140° C. or higher, wherein the insulation film comprising the first insulation layer and the second insulation layer has an elongation at break of 40% or more and an adhesion to the conductor of 30 g/mm or more.

2. An insulated wire as claimed in claim 1, wherein the mixing ratio of the thermoplastic resin having a glass transition temperature of 140° C. or higher in the second insulation layer is from 30 to 70% by weight.

3. An insulated wire as claimed in claim 2, wherein the mixing ratio of the thermoplastic resin having a glass transition temperature of 140° C. or higher in the second insulation layer is from 35 to 55% by weight.

4. An insulated wire as claimed in claim 3, wherein the mixing ratio of the thermoplastic resin having a glass transition temperature of 140° C. or higher in the second insulation layer is from 35 to 45% by weight.

5. An insulated wire, which comprises a conductor, a first insulation layer formed on the conductor, and a second insulation layer formed on the first insulation layer; the first insulation layer comprising a thermosetting polyamideimide as a main ingredient, the second insulation layer comprising a resin, as a main ingredient, formed by mixing a thermosetting polyamideimide with 10 to 90% by weight of a thermoplastic polyetherimide or polyethersulfone; wherein the insulation film comprising the first insulation layer and the second insulation layer has an elongation at break of 40% or more and an adhesion to the conductor of 30 g/mm or more.

6. An insulated wire as claimed in claim 5, wherein the mixing ratio of the thermoplastic polyetherimide or polyethersulfone in the second insulation layer is from 30 to 70% by weight.

7. An insulated wire as claimed in claim 6, wherein the mixing ratio of the thermoplastic polyetherimide or polyethersulfone in the second insulation layer is from 35 to 55% by weight.

8. An insulated wire as claimed in claim 7, wherein the mixing ratio of the thermoplastic polyetherimide or polyethersulfone in the second insulation layer is from 35 to 45% by weight.

9. An insulated wire, which comprises a conductor, a first insulation layer formed on the conductor, and a second insulation layer formed on the first insulation layer; the first insulation layer comprising a thermosetting resin having a glass transition temperature of 250° C. or higher as a main ingredient; the second insulation layer comprising a resin, as a main ingredient, formed by mixing a thermosetting resin having a glass transition temperature of 250° C. or higher with 10 to 90% by weight of a thermoplastic resin having a glass transition temperature of 140° C. or higher; wherein a ratio ($T_1/T_2$) of the thickness ($T_1$) of the first insulation layer to the thickness ($T_2$) of the second insulation layer is within a range of 5/95 to 40/60.

10. An insulated wire as claimed in claim 9, wherein the mixing ratio of the thermoplastic resin having a glass transition temperature of 140° C. or higher in the second insulation layer is from 30 to 70% by weight.

11. An insulated wire as claimed in claim 10, wherein the mixing ratio of the thermoplastic resin having a glass transition temperature of 140° C. or higher in the second insulation layer is from 35 to 55% by weight.

12. An insulated wire as claimed in claim 11, wherein the mixing ratio of the resin (B2) having a glass transition temperature of 140° C. or higher in the second insulation layer (B) is from 35 to 45% by weight.

13. An insulated wire, which comprises a conductor, a first insulation layer formed on the conductor, and a second insulation layer formed on the first insulation layer; the first insulation layer comprising a thermosetting polyamideimide as a main ingredient; the second insulation layer comprising a resin, as a main ingredient, formed by mixing a thermosetting polyamideimide with 10 to 90% by weight of a thermoplastic polyetherimide or polyethersulfone; wherein a ratio ($T_1/T_2$) of the thickness ($T_1$) of the first insulation layer to the thickness ($T_2$) of the second insulation layer is within a range of 5/95 to 40/60.

14. An insulated wire as claimed in claim 13, wherein the mixing ratio of the thermoplastic polyetherimide or polyethersulfone in the second insulation layer is from 30 to 70% by weight.

15. An insulated wire as claimed in claim 14, wherein the mixing ratio of the thermoplastic polyetherimide or polyethersulfone in the second insulation layer is from 35 to 55% by weight.

16. An insulated wire as claimed in claim 15, wherein the mixing ratio of the thermoplastic polyetherimide or polyethersulfone in the second insulation layer is from 35 to 45% by weight.

17. An insulated wire which comprises a conductor, a first insulation layer formed on the conductor, and a second insulation layer formed on the first insulation layer; the first insulation layer comprising a thermosetting resin having a glass transition temperature of 250° C. or higher as a main ingredient; the second insulation layer comprising a resin, as a main ingredient, formed by mixing a thermosetting resin having a glass transition temperature of 250° C. or higher with 10 to 90% by weight of a thermoplastic resin having a glass transition temperature of 140° C. or higher; wherein a residual amount of the solvent in an insulation film comprising the first insulation layer and the second insulation layer is 0.05% by weight or less of the total amount of the insulation film.

18. An insulated wire as claimed in claim 17, wherein the mixing ratio of the thermoplastic resin having a glass transition temperature of 140° C. or higher in the second insulation layer is from 30 to 70% by weight.

19. An insulated wire as claimed in claim 18, wherein the mixing ratio of the thermoplastic resin having a glass transition temperature of 140° C. or higher in the second insulation layer is from 35 to 55% by weight.

20. An insulated wire as claimed in claim 19, wherein the mixing ratio of the thermoplastic resin having a glass transition temperature of 140° C. or higher in the second insulation layer is from 35 to 45% by weight.

21. An insulated wire as claimed in claim 17, wherein the conductor is formed of an oxygen-free copper with an oxygen content of 10 ppm or less.

22. An insulated wire as claimed in claim 17, wherein the insulation film has an elongation at break of 50% or more.

23. An insulated wire as claimed in claim 17, wherein a ratio of the thickness $T_1$ of the first insulation to the thickness $T_2$ of the second insulation layer is within a range of 5/95 to 40/60.

* * * * *